US011234508B2

(12) United States Patent
Kim

(10) Patent No.: US 11,234,508 B2
(45) Date of Patent: Feb. 1, 2022

(54) DRY SHAMPOO BRUSH AND SYSTEM

(71) Applicant: Michelle Kim, San Francisco, CA (US)

(72) Inventor: Michelle Kim, San Francisco, CA (US)

( * ) Notice: Subject to any disclaimer, the term of this patent is extended or adjusted under 35 U.S.C. 154(b) by 0 days.

(21) Appl. No.: 16/870,490

(22) Filed: May 8, 2020

(65) Prior Publication Data

US 2021/0345764 A1 Nov. 11, 2021

(51) Int. Cl.

| | |
|---|---|
| ***A46B 11/00*** | (2006.01) |
| ***A46B 9/06*** | (2006.01) |
| ***A46B 9/02*** | (2006.01) |
| ***A46B 5/00*** | (2006.01) |
| ***A45D 19/00*** | (2006.01) |

(52) U.S. Cl.

CPC ..... *A46B 11/0013* (2013.01); *A46B 5/0095* (2013.01); *A46B 9/023* (2013.01); *A46B 9/06* (2013.01); *A46B 11/0006* (2013.01); *A46B 11/0086* (2013.01); *A45D 19/00* (2013.01); *A46B 9/02* (2013.01); *A46B 2200/104* (2013.01); *A46B 2200/1046* (2013.01)

(58) Field of Classification Search

CPC ... A46B 11/0013; A46B 11/00; A46B 11/003; A46B 11/001; A46B 11/0006; A46B 11/0086; A46B 11/0072; A46B 9/06; A46B 9/065; A46B 9/023; A46B 9/025; A46B 2200/1046; A46B 2200/10; A46B 2200/104; A45D 19/00; A45D 19/0008

USPC ..... 401/270, 279–281, 285, 288, 290; 15/160, 168, 169, 171, 176.1

See application file for complete search history.

(56) References Cited

U.S. PATENT DOCUMENTS

| | | | | |
|---|---|---|---|---|
| 1,763,832 A * | 6/1930 | Taylor | A46B 11/0013 401/279 |
| 2,238,603 A * | 4/1941 | Runnels | A45D 24/16 132/120 |
| 6,098,233 A * | 8/2000 | Chen | A46B 7/04 15/110 |
| 8,277,139 B1 * | 10/2012 | Deans | A46B 11/0013 401/281 |
| 9,364,067 B2 * | 6/2016 | Pham | A46B 11/0055 |

* cited by examiner

*Primary Examiner* — David J Walczak

(74) *Attorney, Agent, or Firm* — John Teresinski; Stites & Harbison PLLC

(57) ABSTRACT

Bush applicators including hair brush applicators and containers for dispensing dry shampoo are provided. In one embodiment, a brush applicator includes a body having one or more channels to distribute material to a bristle assembly. The bristle assembly can include a plurality of bristle and brush elements. The brush elements may be interspersed with the bristle elements and can each include a shaft and end (e.g., tip). Another embodiment is directed to a brush applicator including a container coupled to a body. The container retains at least one material including powder, liquids and solutions. Another embodiment is directed to a brush applicator configured for application of dry shampoo to hair.

20 Claims, 15 Drawing Sheets

DRY SHAMPOO BRUSH AND SYSTEM

FIELD

The present disclosure relates to applicator brushes, and more particularly to brush applicators for hair, makeup and distribution of material with an applicator.

BACKGROUND

Conventional hair brushes come in many designs and configurations. Unlike combs which are generally formed of a single row of tines, hairbrushes usually have many more elements supported by a handle. Conventional hair brushes can employ bristles that are stiff or soft. Many conventional hair brushes generally include a single type of brush element. Conventional brushes are not configured to apply product to hair and require some other means of distribution. Although there are many conventional brush designs for hair and other purposes, there exists a need for hair brush elements configured to apply products to hair.

There additionally exists a need to reduce product waste from a brush applicator. Some conventional applicators require application of a product by way of hand or from a product container. As a result, product is often wasted or difficult to apply. There exists a need for a brush applicator and brush applicator configurations which allows for improved product application.

BRIEF SUMMARY OF THE EMBODIMENTS

Disclosed and claimed herein are brush applicators and brush applicator configurations. One embodiment is directed to a brush applicator including a bristle assembly base having at least one channel, and a plurality of bristle elements extending from the bristle assembly base, wherein the bristle elements extend out from the bristle assembly base. The brush applicator includes a plurality of brush elements extending from the bristle assembly base, wherein the brush elements extend out from the bristle assembly base and are interspersed with the bristle elements, the brush elements each include a shaft and tip, and wherein the at least one channel of the bristle assembly base is configured to distribute material to the plurality of bristle elements and the plurality of brush elements.

In one embodiment, the bristle assembly base is a portion of a bristle assembly configured to removably mount to a body and base including the at least one material.

In one embodiment, the plurality of bristle elements include bristles having a width smaller than each shaft of the brush elements.

In one embodiment, the plurality of brush elements include an inner configuration and an outer configuration of brush elements, wherein the inner configuration includes a first layout formation and the outer configuration is associated with a second layout formation.

In one embodiment, the bristle assembly base is configured to engage with a body to be attached, the body configured to be removably attached to at least one container by at least one of a threaded connection and a tab ring.

In one embodiment, the brush applicator is configured for application of dry shampoo to hair.

In one embodiment, the brush applicator is configured to dispense at least one of a powder, liquid and solution.

In one embodiment, the bristle assembly base includes at least one flow tube to dispense material to the plurality of bristle elements and the plurality of brush elements.

In one embodiment, the bristle assembly base is configured to be coupled to and retained between a body and a sleeve, the sleeve configured to rotate to rise and lower the bristle assembly base with respect to the body.

In one embodiment, the bristle assembly base includes four openings to release material.

Another embodiment is directed to a brush applicator including a body having a base plate, the base plate including at least one channel, and a base coupled to the body, the base configured to retain at least one material. The brush applicator also includes a bristle assembly including plurality of bristle elements and plurality of brush elements extending from a bristle assembly base, wherein the brush elements and are interspersed with the bristle elements, the brush elements each include a shaft and end, and wherein the at least one channel of the body is configured to distribute the at least one material to the plurality of bristle elements and the plurality of brush elements. The brush applicator also includes a sleeve configured to retain the bristle assembly to the body.

In one embodiment, the base is configured to receive and removably mount to the body.

In one embodiment, the plurality of bristle elements include bristles, each bristle having a width smaller than the shaft of the brush elements.

In one embodiment, the plurality of brush elements include an inner configuration and an outer configuration of brush elements, wherein the inner configuration includes a layout different from the outer configuration.

In one embodiment, the bristle assembly is configured to be coupled to and retained between and the body and the sleeve, the sleeve configured to rotate to rise and lower with respect to the body.

In one embodiment, the brush applicator is configured for application of dry shampoo to hair.

In one embodiment, the brush applicator is configured to dispense at least one of a powder, liquid and solution.

In one embodiment, the bristle assembly base includes at least one flow tube to dispense material to the plurality of bristle elements and the plurality of brush elements.

In one embodiment, the body includes at least one tab to retain the bristle assembly to a base plate of the body.

In one embodiment, the body includes a sidewall having a channel to adjust position of the sleeve.

In one embodiment, the body and a bristle assembly base includes four openings to release material from the base to the bristle assembly.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

Figure 1B:
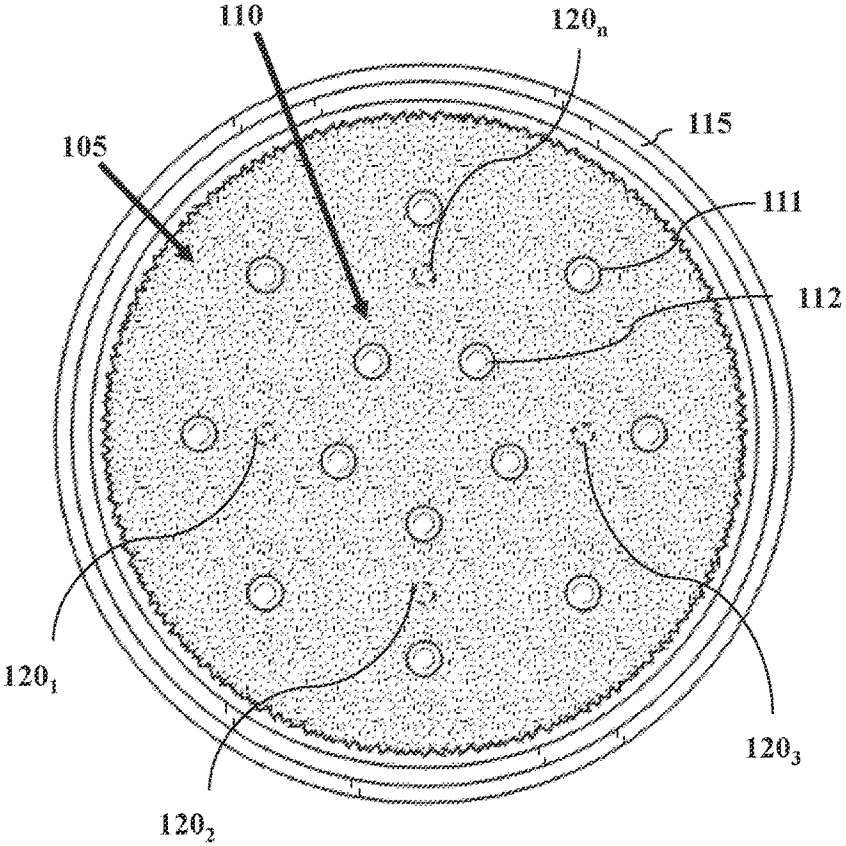
FIGS. 1A-1B depict an applicator according to one or more embodiments.

One aspect of the disclosure is directed to brush applicators. A brush applicator as described herein, may include one or more brush elements and bristle elements and may be configured to apply a product, such as dry shampoo to hair. In one embodiment, a configuration for a hair brush bristle assembly is provided including a bristle elements and brush elements. The bristle assembly may be included with a brush applicator. According to another embodiment, applicator configurations are provided for at least one of dispensing and supplying material to the bristle assembly. Brush applicators are configured to supply material to elements of the applicator, such as a bristle assembly, and allow for application of the material by a user. As will be discussed herein, one aspect of the disclosure is directed to application of a product, such as one or more of a personal hygiene product, cleanser, makeup, beauty product and personal product in general. Uses for the brush applicator can include application of makeup, and distribution of material including but not limited to dry shampoos, powders, makeups, hair powders, and powders in general. According to another aspect, the brush applicator may be configured for applying one or more of a solid/granular material, powder, liquid, and solution (i.e., liquid including solid materials).

In one embodiment, a brush applicator is configured for use as a component of a hair brush. The brush applicator can include a body with a base plate having at least one channel to allow a material, such as a dry shampoo, to be supplied to bristle and brush elements. In one embodiment, the brush applicator includes a bristle assembly having bristle elements and brush elements. The brush elements may be interspersed with the bristle elements. According to one embodiment, the brush elements each include a shaft and end (e.g., tip, spheroid end, etc.). In one embodiment, at least one channel of a bristle assembly base plate is configured to distribute at least one material to the plurality of bristle elements and the plurality of brush elements. One or more elements of the brush applicator may be configured to receive and/or distribute dry shampoo to the bristle and brush elements. The brush applicator may be configured for application of dry shampoo to hair. The design of the brush applicator allows for coating hair with dry shampoo while simultaneously stripping away oil to leave hair feeling clean.

Another embodiment is directed to a brush applicator system including a brush applicator and one or more elements, such as a container for material. A plurality of brush applicator configurations are described including features, such as an interfacing container, storage lid, movable collar/sleeve, and brush and bristle configuration patterns. The brush applicator may be used with different types of material. According to another embodiment, the brush applicator may allow for a plurality of containers including rigid walls containers and squeeze tubes.

Another embodiment is directed to a bristle assembly and bristle configurations. The bristle configuration may be applied to a base or handle to dispense material, such as dry shampoo. Configurations and components discussed herein allow for application of dry shampoo to a hair brush and storage of dry shampoo in at least one hair brush compartment.

Another aspect of the disclosure is directed to providing alternative products to aerosol shampoo products. In one embodiment, a brush applicator configuration is provided as a healthier, more efficient, and environmentally friendly alternative to aerosol dry shampoo. The brush applicator configuration includes one or more elements to apply powder, such as dry shampoo, directly to brush elements. By brushing hair after application of the powder, the powder has minimal contact with the scalp. By using a brush applicator configuration, improved scalp and hair separation may be provided in order to coat the hair with the dry shampoo powder more effectively while also stripping away any residue with subsequent brushing. The hair brush configuration may eliminate the need to spray hair with dry shampoo and then brush out the powder with a brush.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

Figure 1A:
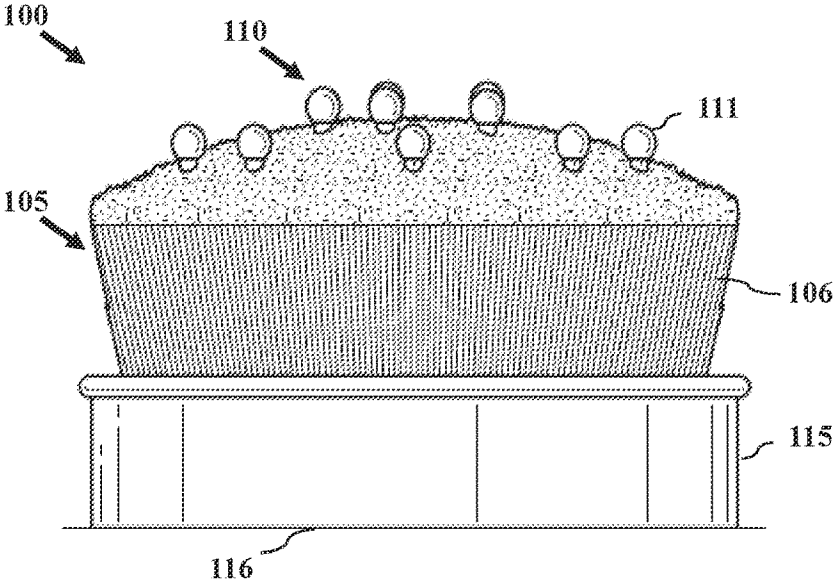

Referring now to the figures, FIGS. 1A-1B depict graphical representations of a brush applicator according to one or more embodiments. According to one embodiment, a brush applicator can include a plurality of bristle elements and a plurality of brush elements.

FIG. 1A shows brush applicator 100 including according to one or more embodiments. In one embodiment, brush applicator 100 includes a plurality of bristle elements 105 and a plurality of brush elements 110. According to another embodiment, brush applicator 100 includes body 115. Body 115 may be configured to retain bristle elements 105 and brush elements 110.

According to one embodiment, bristle elements 105 relate to a plurality of bristles, such as bristle 106. According to one embodiment, brush applicator 100 includes a dense coverage of bristle elements 105. As shown in FIG. 1A, the brush head profile formed by bristle elements 105 is rounded. In certain embodiments, the brush head profile formed by bristle elements 105 may have a flat or substantially flat top profile. Bristle elements 105 may be formed from natural materials (e.g., animal hair) and/or synthetic bristles. Bristle elements 105 may extend out from body 115. In one embodiment, the bristle elements 105 each have a width smaller than the shaft of brush elements 110. By way example, bristle elements may have a thickness associated with natural hair and/or synthetic hair. In certain embodiments, bristle elements 105 may have a mixed ratio of bristle lengths, such that some bristle elements are have a first or shorter length, and other bristle elements have a second or additional length that is longer.

In one embodiment, brush elements 110 relate to a second type of brush element for brush applicator 100. Brush elements 110 may be interspersed among bristle elements 105. According to one embodiment, brush elements 110 each include a shaft and tip such as a spheroid or oval like end, such as end 111. According to one embodiment, end 111 relates to a sphere-like but not perfectly spherical body for spheroid. In certain embodiments, end 111 is spherical. Brush elements 110 may extend out from body 115.

According to another embodiment, at least one channel of the body 115 is configured to distribute at least one material to the plurality of bristle elements 105 and the plurality of brush elements 110 of brush applicator 100. As will be described herein below, one or more channels or flow tubes may be provided by elements to allow for material to be distributed and/or dispensed to brush and bristle elements.

According to another embodiment, features and characteristics of brush applicator 100 are configured to brush hair and apply a material, such as a dry shampoo product to hair. In one embodiment, the material, such as a dry shampoo product, may be applied directly to brush applicator from within body 115 prior and/or during hair brushing. According to another embodiment, brush applicator 100 is configured to dispense one or more materials, including at least one of a powder, liquid and solution. As will be discussed in more detail below, bottom surface 116 of body 115 may interface with one or more containers or elements for a supply of material to dispense.

According to one embodiment, bristle elements 105 and brush elements 110 have multiple functions. In one embodiment, the brush elements 110 include tips and are longer in length than the thin bristles of bristle elements 105. By way of example, tips of brush elements 110 may extend above the tips of bristle elements 105. Brush elements 110 may be longer than the bristles to avoid adverse effects that dry shampoo has on the scalp (i.e. scalp dryness, itchiness, clogged pores, temporary or permanent balding).

According to one embodiment, brush elements 110 may be formed of a single material. In one embodiment, brush elements 110 each include a single body structure formed from molded plastic, or formed of a single material (e.g., plastic, polymer, natural rubber, etc.). According to another embodiment, brush elements 110 are formed of multiple materials. When hair is passed around brush applicator 100, material, such as dry shampoo, may be applied to the hair and scalp. One or more of bristle elements 105 and brush elements 110 may be flexible such that contact with hair and/or scalp results in a deformation. According to one embodiment, bristle elements 105 and brush elements 110 may be components of a bristle assembly and/or be formed as part of a bristle assembly.

According to one embodiment, brush applicator 100 may be produced in multiple sizes and shapes (e.g., circular, quadrilateral, oval, etc.). In additional, brush applicator 100 may be applied to one or more types of containers including squeeze tubes and rigid (e.g., non-deformable) containers. Configurations herein may also be sized (and/or shaped) according to the size of a hair brush, container, the number of brush elements to include, the spacing or pattern of brush elements, etc. It should be appreciated that the principles of the disclosure may be applied to other configurations for a hair brush.

According to one embodiment, body 115 may be a structure having at least one channel. Body 115 may include a storage area and/or may be couple to a container for material to dispense. Bristle elements 105 and brush elements 110 may each be secured (e.g., glued, bonded, taped, etc.) to a surface of body 115. In one embodiment, body 115 is configured to receive and removably mount to a container, such as container 160 of FIG. 1D or container 217 of FIGS. 2A-2B, including the at least one material. According to one embodiment, brush applicator 100 may be used with other components including but not limited to a handle, larger hair brush, etc.

FIG. 1B depicts a top down or plan view of brush applicator 100 according to one or more embodiments. As shown in FIG. 1B, brush elements 110 are interspersed among bristle elements 105. Bristle elements 105 are densely provided resulting in a bristle formation. According to one embodiment, brush elements 110 may be placed relative to bristle elements 105 according to an arrangement. In one embodiment, brush elements 110 include an outer configuration of brush elements (such as brush element 111) and an inner configuration (such as brush element 112). According to one embodiment, the inner configuration and outer configuration each include a different layout (e.g., first layout formation, second layout formation). By way of example, the inner configuration of brush elements 110 may be associated with a pentagon shape, while the outer configuration may be associated with a circular/semi-circular shape.

As shown in FIG. 1B, brush applicator 100 includes a representation of channels, shown by channels $\mathbf{120}_{1\text{-}n}$ relative to bristle elements 105 and brush elements 110. According to one embodiment, brush applicator 100 includes channels $\mathbf{120}_{1\text{-}n}$ for distribution of material to bristle and brush elements.

Figure 1D:
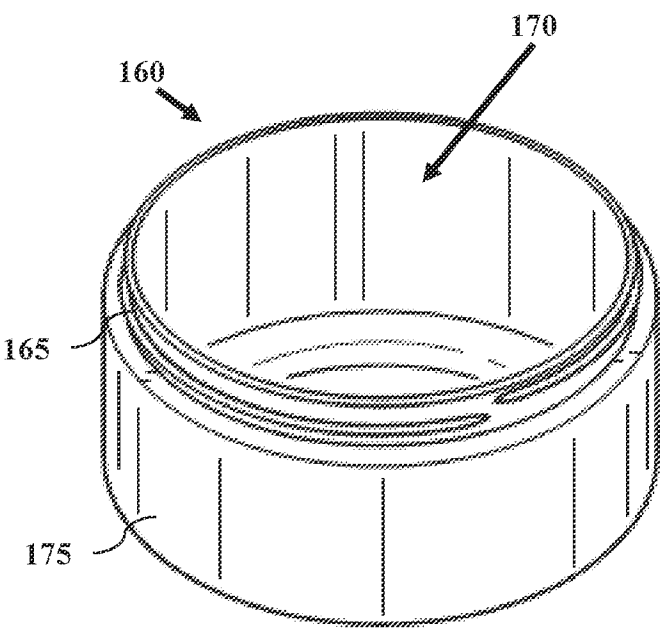
FIG. 1D depicts an exemplary container for the applicator of FIGS. 1A-1B according to one or more embodiments.
Figure 1C:
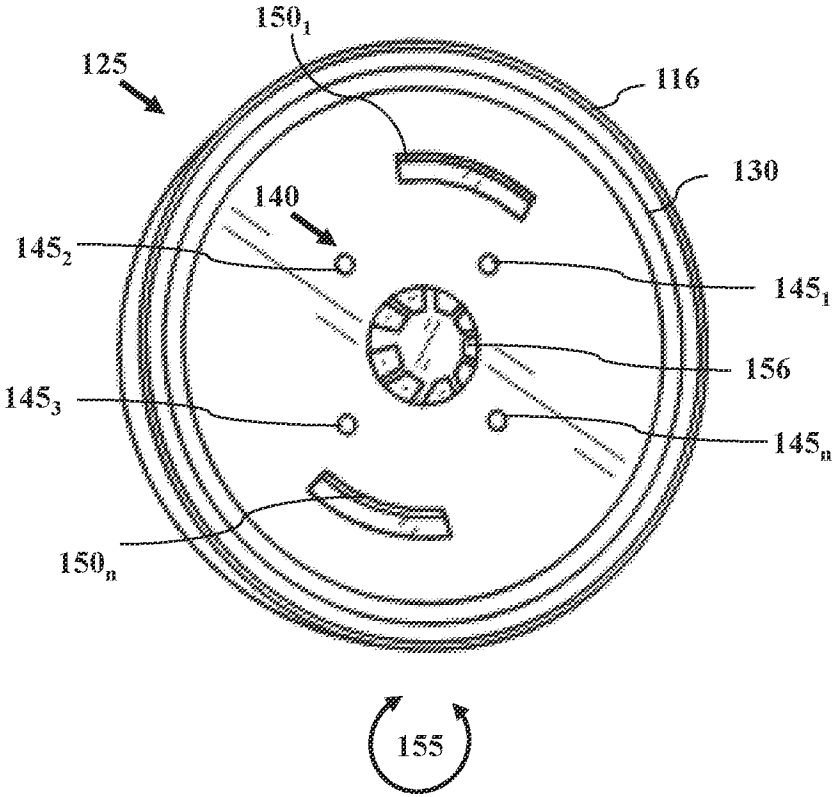
FIG. 1C depicts structural elements of an applicator according to one or more embodiments.

FIG. 1C depicts structural elements of an applicator according to one or more embodiments. FIG. 1C depicts a bottom configuration 125 of body 115 of brush applicator 100 according to one or more embodiments. Body 115 may be configured to be removably attached to at least one container by elements 130 providing at least one of a threaded connection and a tab ring. According to another embodiment, configuration 125 includes hole pattern 140 for channels of body 115 including a plurality of channels $\mathbf{145}_{1\text{-}n}$. Hole pattern 140 includes four circular channels arranged in a pattern, such as a square formation. In certain embodiments, channels of $\mathbf{145}_{1\text{-}n}$ may be adjustable to allow for opening and/or closing one or more channels. In one embodiment, body 115 includes a moveable element configured to open and close the at least one channel to dispense material. According to one embodiment, body 115 includes a rotatable plate along guides $\mathbf{150}_{1\text{-}n}$ which may be configured to rotate, as shown by direction 155 to open and/or close channels $145_{1-n}$. According to one embodiment, body 115 includes a built-in rotating stopper provide user control of material flow, such as dry shampoo powder onto the brush applicator. In certain embodiments, body 115 may be pressed onto a container for attachment, and similarly be pulled off to allow for pop-on and pop-off attachment. In other embodiments, body 115 may be screwed on and off of a container. According to another embodiment, body 115 may optionally include a recess to secure a body, shown by 156, of one or more of bristle elements and brush elements. According to another embodiment, body 115 includes a moveable element configured to open and close the at least one channel to dispense material.

FIG. 1D depicts a container for the applicator of FIGS. 1A-1B according to one or more embodiments. According to one embodiment, container 160 may include rim 165 to interface with a body 115. In certain embodiments, rim may interface with element 130 of FIG. 1C to allow body 115 to be removably attached to container 160 by at least one of a threaded connection and a tab ring. Container 160 relates to a cylindrical container having storage area 170 for material. According to one embodiment, container 160 includes sidewall 175. Container 160 may have a cylindrical shape, as shown in FIG. 1D. It should be appreciated that container 160 may relate to other shapes and configurations. In other embodiments, container 160 may be applied to different container types including squeeze tubes and rigid structures.

According to another embodiment, container 160 is configured for storing dry shampoo and application of the dry shampoo to brush applicator 100. Container 160 may be a cup configured to removably attach to brush applicator 100 and dispense dry shampoo to brush elements from underneath or behind the brushes.

Figure 2B:
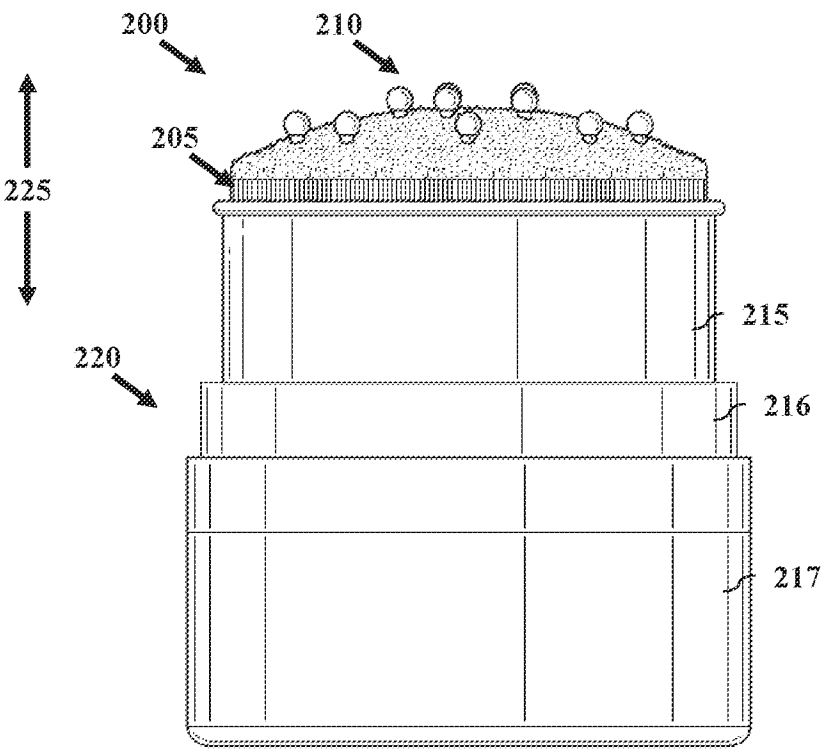
FIGS. 2A-2B depict an applicator according to one or more embodiments.
Figure 2A:
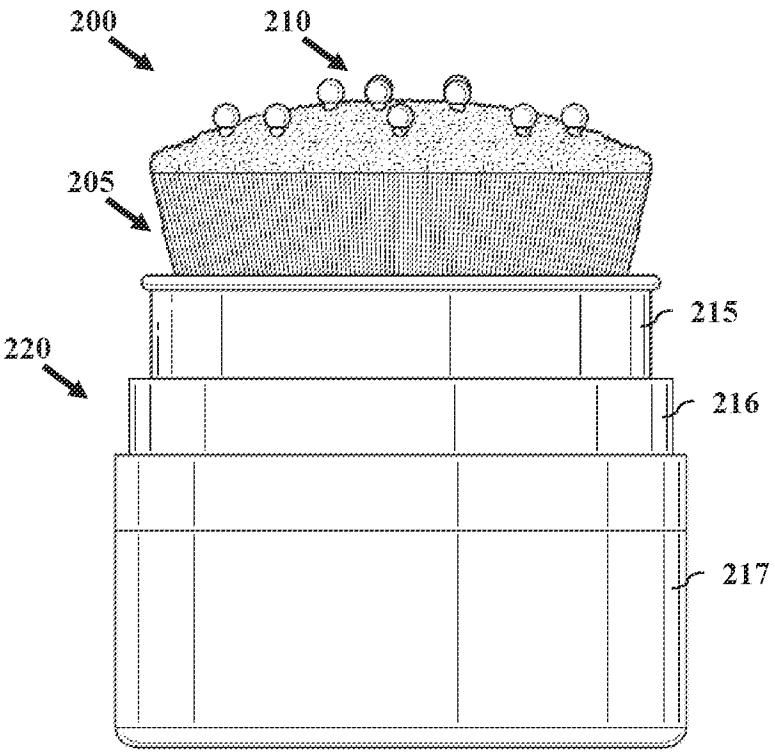

In one embodiment, body 115 is configured to receive and removably mount to a container, such as container 160 of FIG. 1D or container 217 of FIGS. 2A-2B, including at least one material.

FIGS. 2A-2B depict an applicator according to one or more embodiments. Applicator 200 relates to another embodiment of the applicator of FIG. 1.

FIG. 2A shows brush applicator 200 including a plurality of bristle elements 205 and a plurality of brush elements 210. According to another embodiment, brush applicator 200 includes body 220 including a container 217. Body 220 may be configured to retain bristle elements 205 and brush elements 210. According to another embodiment, body 220 may be removably coupled to container 217. In one embodiment, container 217 is configured to retain at least one material.

According to another embodiment, the body 220 includes a movable collar 215 configured to raise and lower relative to a first position and a second position, wherein the first position and second position adjust the configuration of bristle elements 205. According to one embodiment, collar 215 may move vertically relative to support 216 of body 220. In certain embodiments, collar 215 may relate to a sleeve. Collar 215 may relate to a sleeve element coupled to body 220 and configured to be raised and lowered vertically. In another embodiment, collar 215 may relate to a sleeve configured to rotate relative to body 220. Rotation may be based on a guide in body 220. Support 216 may be configured to retain brush and bristle elements and engage with container 217. FIG. 2A shows collar 215 in a first or lowered position. With collar 215 in a lowered position, ends of bristle elements 215 are splayed to present a mushroom or spread configuration.

FIG. 2B shows collar 215 in a second or raised position. Vertical direction 225 represents movement directions of collar 215. With the collar 215 in a raised position, ends of bristle elements 215 are pulled in. In some embodiments, collar 215 may move to one or more intermediary positions between the lowered and raised views shown in FIGS. 2A-2B.

Figure 3:
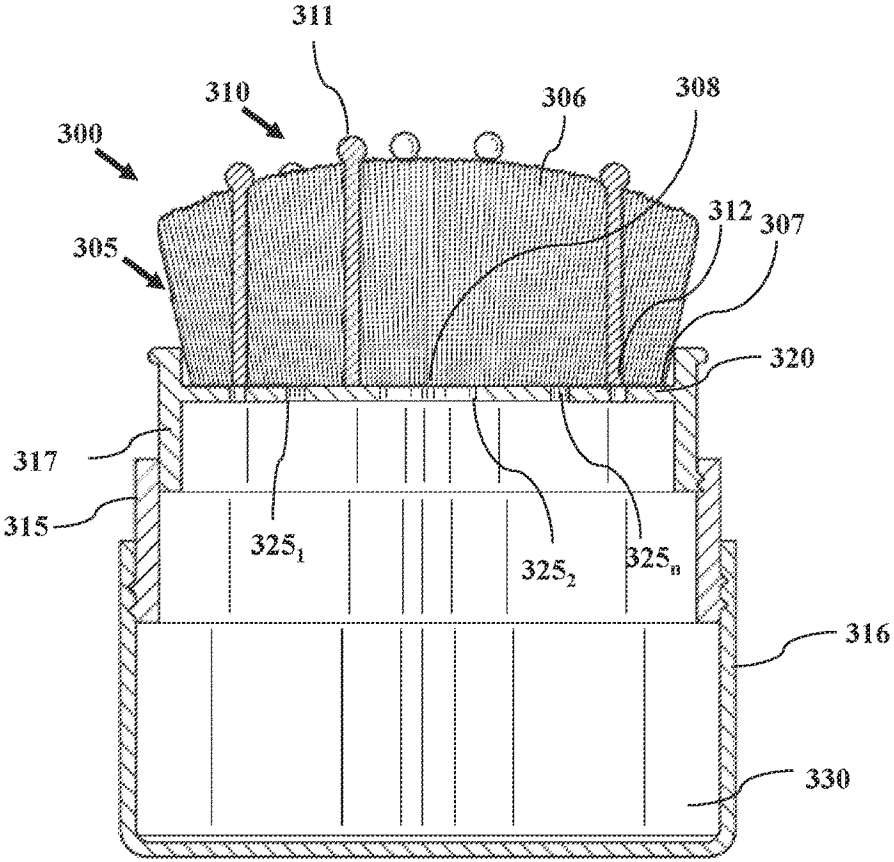
FIG. 3 depicts a cross sectional view of an applicator according to one or more embodiments.

FIG. 3 depicts a cross sectional view of a brush applicator according to one or more embodiments.

Applicator 300 may relate to another embodiment of the applicator of FIG. 1 or FIGS. 2A-2B. FIG. 3 shows brush applicator 300 including a plurality of bristle elements 305 and a plurality of brush elements 310. According to one embodiment, bristle elements 305 and brush elements 310 may be components of a bristle assembly and/or be formed as part of a bristle assembly. According to another embodiment, brush applicator 300 includes body 315 and may be configured to interface with container 316 and collar 317. Body 315 may be configured to retain bristle elements 305 and brush elements 310. According to another embodiment, body 315 may be removably coupled to container 316. In one embodiment, container 316 is configured to retain at least one material in storage area 330.

According to another embodiment, body 315 includes collar 317 and support 320. In one embodiment, collar 317 may be moveable and may move relative to body 315 and support 320. According to another embodiment, support 320 may rotate relative to body 315 and collar 317. According to another embodiment, ends of bristle elements 305 and brush elements 310, shown as 307 and 312, respectively, may be fixed to support 320 of body 315. According to another embodiment, support 320 of body 315 may include a plurality of channels shown as $325_{1-n}$ which may be configured to supply material from storage area 330 of container 317 to bristle elements 305 and brush elements 310. Body 315 may include one or more flow tubes not shown in FIG. 3.

According to one embodiment, bristle elements 305 may include a plurality of bristles, wherein the bottom portions of each bristle are bound together. By way of example, in one embodiment, the bottom end of bristle elements 305 may be fused by one or more of heat treatment (e.g., melting) and/or a binding material (e.g., adhesive) to join the bottom ends of the bristles. In certain embodiments, bound ends of the bristles may form fused portion 308 of bristle elements 305 that may then be fixed to support 320. In certain embodiments, fused portion 308 may be drilled or machined to create one or more holes or passages to allow for the flow of dry shampoo.

Figure 4:
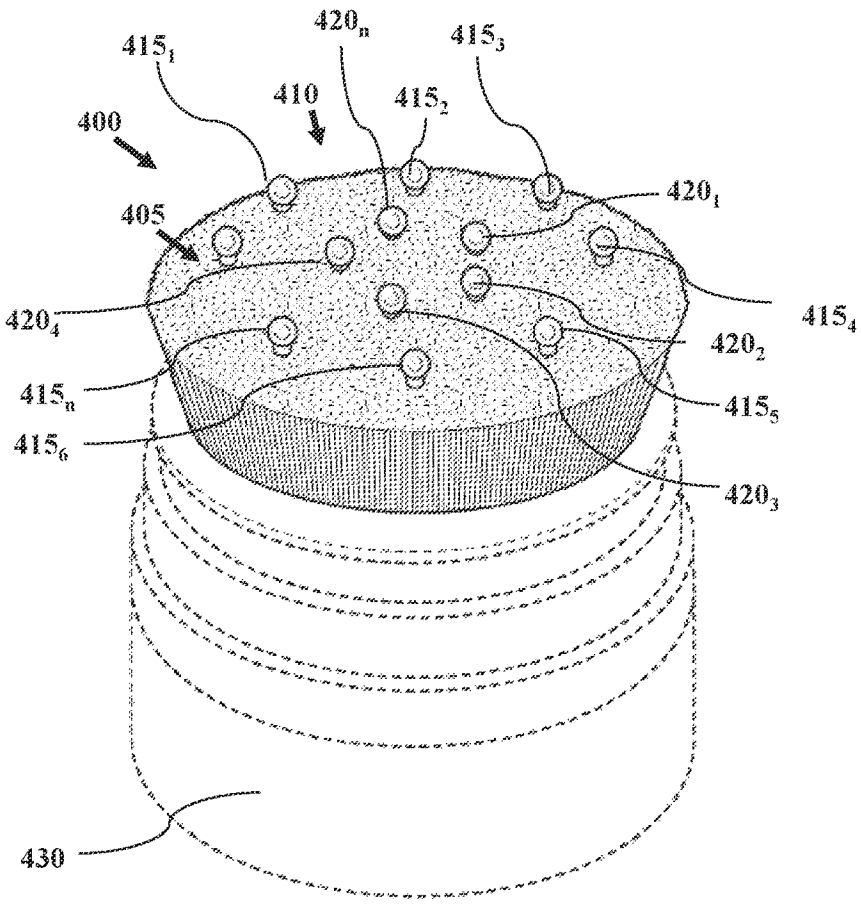
FIG. 4 depicts an applicator bristle configuration according to one or more embodiments.

FIG. 4 depicts an applicator bristle configuration according to one or more embodiments. Bristle configurations as described herein may be applied to one or more brush configurations. According to one embodiment a bristle configuration includes a first type of elements and a second type of elements. FIG. 4 depicts a bristle configuration 400 having brush elements 410 are interspersed among bristle elements 405. According to one embodiment, bristle configuration 400, bristle elements 405 and brush elements 410 may be components of a bristle assembly and/or be formed as part of a bristle assembly. Bristle elements 405 are densely provided resulting in a surface (e.g., mushroom shape). According to one embodiment, brush elements 410 may be placed relative to bristle elements 405 according to an arrangement. In one embodiment, brush elements 410 include an outer configuration of brush elements (brush elements $415_{1-n}$) and an inner configuration (brush elements $420_{1-n}$) According to one embodiment, the inner configuration and outer configuration each include a different layout.

By way of example, the inner configuration of brush elements $420_{1-n}$ may be associated with a pentagon shape, while the outer configuration $415_{1-n}$ may be associated with a circular/semi-circular shape. Bristle configuration 400 may be mounted/coupled to an optional container body 430.

Figure 5B:
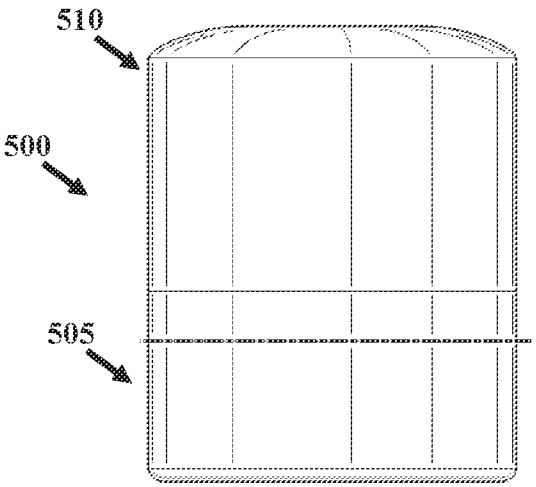
FIGS. 5A-5B depict an applicator and lid system according to one or more embodiments.
Figure 5A:
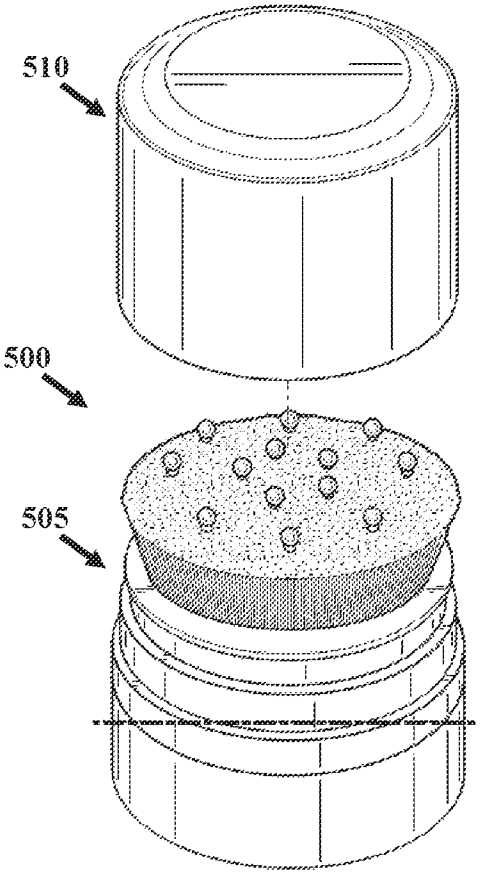

FIGS. 5A-5B depict an applicator and lid system according to one or more embodiments. According to one embodiment, a brush applicator system 500 includes a brush applicator 505 and removable lid 510. FIG. 5A shows lid 510 removed from brush applicator 505. FIG. 5B shows lid 510 coupled to brush applicator 505.

Figure 6:
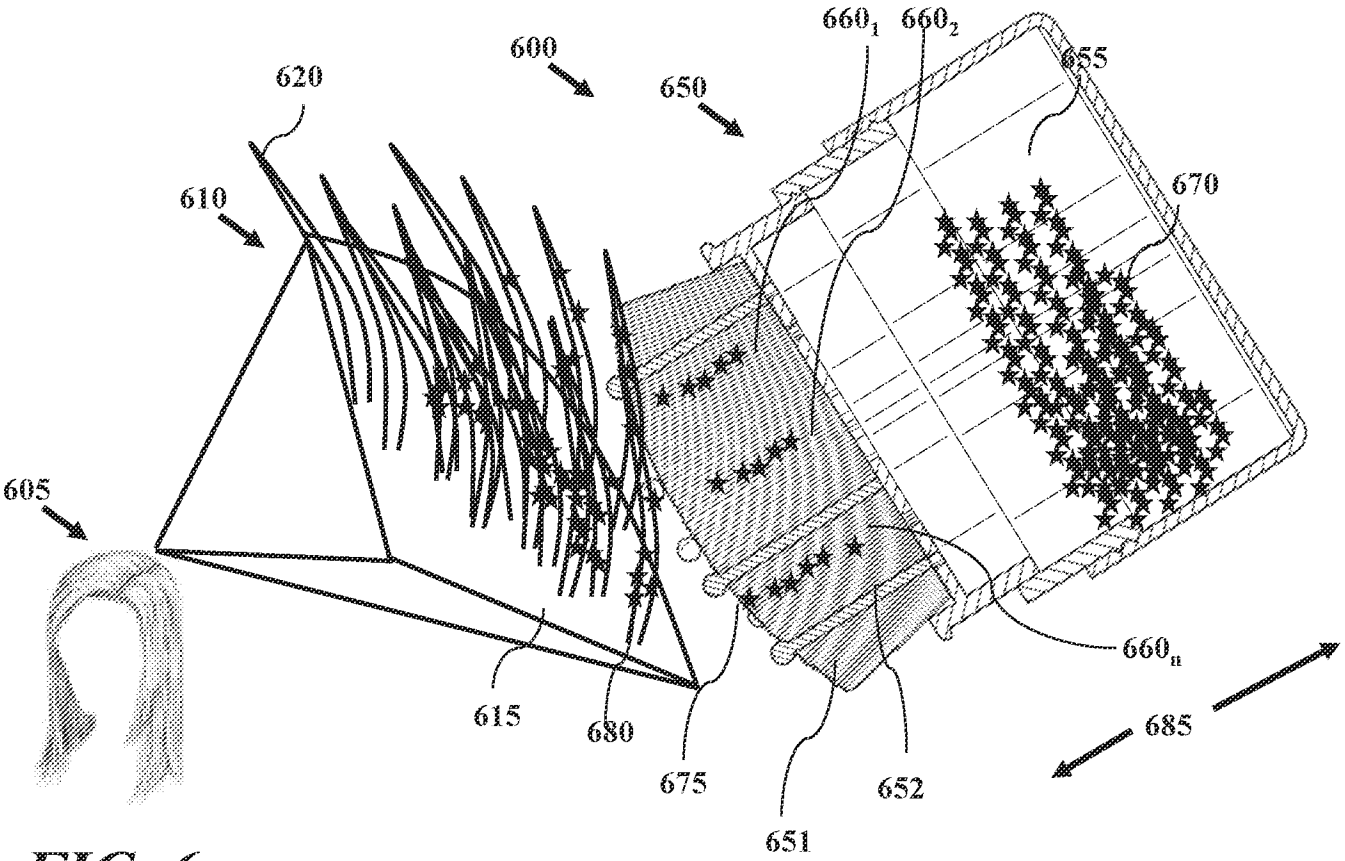
FIG. 6 depicts a graphical representation of the applicator with hair according to one or more other embodiments.

FIG. 6 depicts a graphical representation of the applicator according to one or more other embodiments. FIG. 6 shows configuration 600 for operation of brush applicator relative to hair 605. One benefit of configurations descried herein is the ability to keep material, such as powder, off scalp 615. Section 610 is an enlarged view of hair 605 including scalp 615 and hair follicles shown as 620. According to one embodiment, brush applicator 650 is configured to apply material to the hair and one or more elements of the brush applicator may interact with hair and scalp 615. According to one embodiment, brush applicator 650 includes bristle elements 651, brush elements 652 and storage area 655 including material 670 (e.g., dry shampoo, beauty product, etc.). Brush applicator 650 also includes a plurality of channels $660_{1-n}$ to supply material, shown as 675 to bristles 651 and brushes 652. According to one embodiment, brush applicator may be moved through hair 605. In addition, material 670 from storage area 655 may be released to hair follicles 620 shown as 680. In certain embodiments, movement (shown as 685) relative to a center axis of brush applicator may release additional material. During use, bristle elements 651 may distribute material such as the dry shampoo powder to hair follicles 620. Brush elements 652 may interact with scalp 620 to collect material and to collect/distribute dry shampoo from hair follicles 620.

FIGS. 7A-7L depict graphical representations of a brush applicator and brush applicator components according to one or more other embodiments.

Figure 7B:
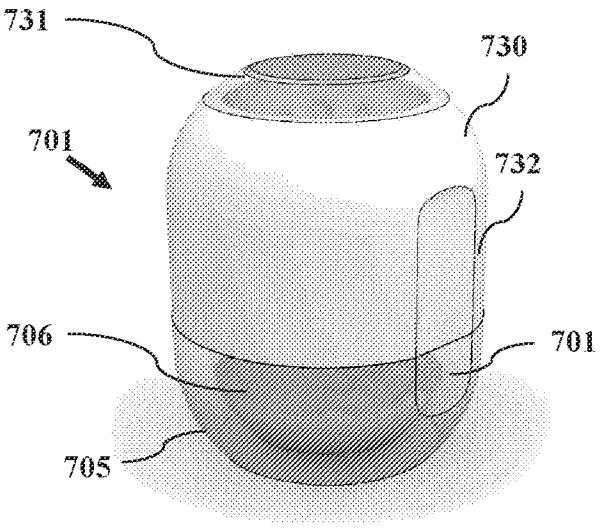
FIGS. 7A-7L depict graphical representations of a brush applicator and brush applicator components according to one or more other embodiments.
Figure 7A:
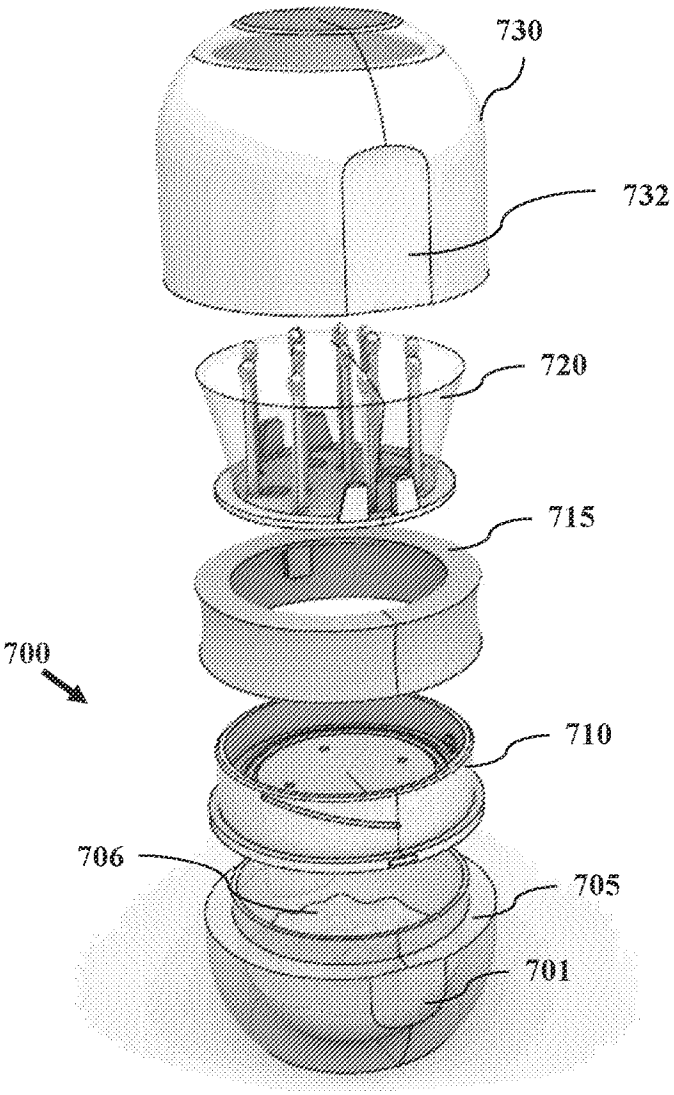

FIG. 7A shows a dissembled view of brush applicator 700. Brush applicator 700 may include similar elements and provide similar operation as brush applicator 200 of FIG. 2 to dispense dry shampoo or other material. Brush applicator 700 may relate to another embodiment of brush applicator 200 and includes one or more features and configurations that may be employed by the brush applicator configuration of FIG. 2.

According to one embodiment, brush applicator 700 includes abase 705, body 710, sleeve 715 and bristle assembly 720. Brush applicator 700 may be configured to retain and dispense material, such as dry shampoo, powder, and other materials. As shown in FIG. 7, base 705 includes an opening to receive and for storage of material 706. According to another embodiment, base 705 may be separately removed from/attached to body 710. The outer surface of base 705 and lid 730 may include grip cutouts, shown as 701 and 732 respectively. Grip cutouts may relate to scalloped portions, cutaways and/or flat surfaces that allow for base 705 to be gripped, lid 730 to be removed, and body 715 to be separated and/or attached to base 705. The order of elements as shown in FIG. 7A are not indicative of the order of assembly as sleeve 715 retains bristle assembly relative to body 710. Brush applicator 700 may optionally include lid 730 which may be removable from the brush applicator during use. FIGS. 7B-7L illustrate one or more features of brush applicator 700 in more detail.

FIG. 7B shows brush applicator 700 with lid 730 attached as configuration 701. Lid 730 may be configured to protect bristle elements of brush applicator 700. Lid 730 may include one or more features. Lid 730 may be configured to engage with brush applicator 700 by way of one or more of a snap fit, compression fit, and/or engagement with components of the brush applicator 700, such as the outer surface of sleeve 715. Lid 730 may include one or more flat surfaces, such as 731, and 732 functioning as a gripping surface. Surface 732 of lid 730 may align with flat surface 701 of base 705. In certain embodiments, base 705 and lid 730 include a pair of flat surfaces as grips. In other embodiments, base 705 and lid 730 include four flat surfaces as grips.

Figure 7D:
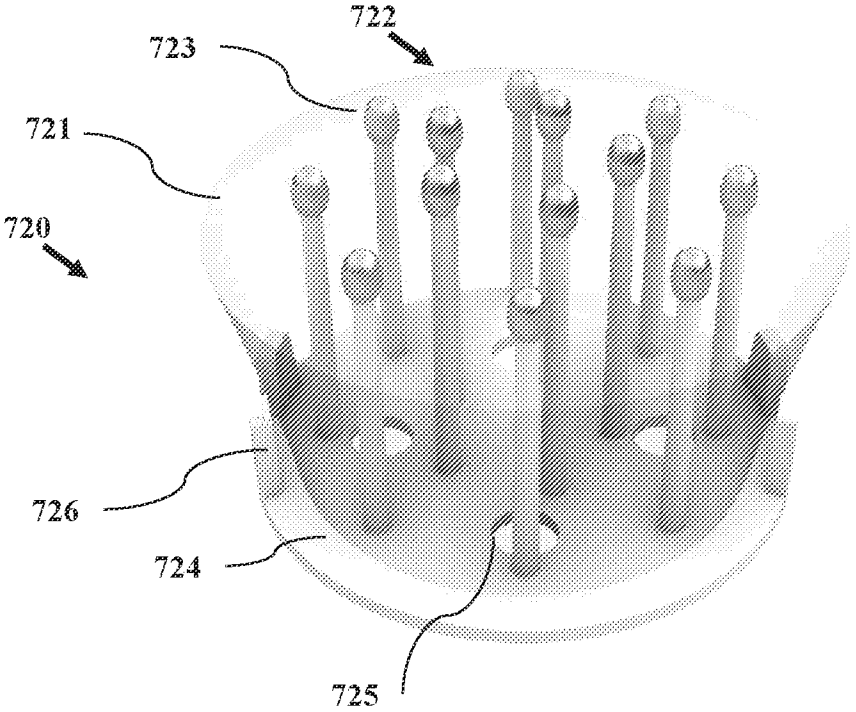
Figure 7C:
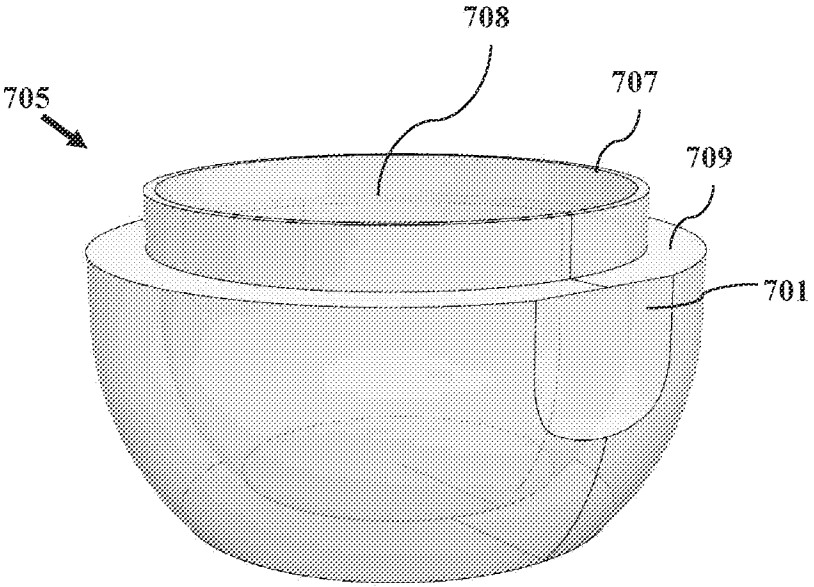

FIG. 7C shows base 705 of brush applicator 700. Base 705 may relate to a semi-conical cup structure having a flat bottom, curved outer surface and interior compartment 708. Interior compartment 708 may include a curved surface to retain material, such as dry shampoo, for example. Base 705 includes flange 707 that extends up from the interior compartment 708 and flat rim 709. According to one embodiment, flange 707 may be configured to receive at least a portion of body 710. In addition, at least a portion of body 710 may engage with the flat surface of rim 709. According to one embodiment, base 705 may be molded from one or more materials, including polymers and plastics. In certain embodiments, base 705 may be transparent or clear to allow for viewing of the contents retained.

FIG. 7D illustrates bristle assembly 720 according to one or more embodiments. According to one embodiment, bristle assembly 720 includes a plurality of bristle elements 721 (e.g., bristle elements 105) and a plurality of brush elements 722 (e.g., brush elements 110). Bristle assembly 720 may include two types of protrusions (e.g., bristles and brushes) that extend from bristle assembly base 724. According to one embodiment, bristle elements 721 relate to a short and long ratio of soft bristles and are combined with brush elements 722 formed of harder bristles (e.g., Nylon) with provides a configuration to disperse, apply, and brush material, such as dry shampoo through hair with one motion According to one embodiment, bristle assembly 720 may be configured to keep material, such as dry shampoo, off of a scalp and to deliver product to hair follicles.

Bristle assembly base 724 may be configured to retain bristle elements 721 and brush elements 722. According to one embodiment, bristle elements 721 can include a plurality of fibers having a substantially uniform thickness. Bristle elements 721 can have a fused ends (e.g., fused portion 308). Brush elements 722 may have a larger diameter compared to bristle elements 721 and have far fewer elements. According to one embodiment, brush elements 722 may be formed of molded elements having uniform shaft thickness and rounded tips, such as rounded tip 723.

According to one embodiment, bristle assembly 720 includes a bristle assembly base 724 which may have a circular disk structure configured to retain at least one of bristle elements 721 and brush elements 722. In one embodiment, bristle assembly base 724 is fabricated with brush elements 722. According to another embodiment, brush elements 722 may be formed with bristle assembly base 724 and one more features of bristle assembly base 724. By way of example, brush elements 722 and bristle assembly base 724 may be formed by injection molding such that a uniform structure is formed. According to one embodiment, by forming rounded tips that are molded, bristle tips will not shed, break, or fall out. According to yet another embodiment, bristle elements 721 may be injection molded to brush elements 724.

According to one embodiment, bristle assembly base 724 includes a plurality of openings, such as opening 725. Openings of base 724, such as opening 725 may be configured to allow material within base 705 release to bristle assembly 720. According to one embodiment, openings in bristle assembly base 724 correspond to openings in a fused base of bristle elements 721. The fused portion of the bristle elements 721 may be formed with openings or machined (e.g., drilled, cut, etc.) to provide a pathway and/or openings to correspond with openings of bristle assembly base 724.

According to another embodiment, bristle assembly base 724 may be configured to retain a base of bristle elements 721 and such as a fused portion of the bristles. Bristle assembly base 724 may be configured to be received and retained within body 710. In another embodiment, bristle assembly base 724 includes at least two raised tabs, such as tab 726, which may be configured to engage with one or more components of brush applicator 700.

Figure 7F:
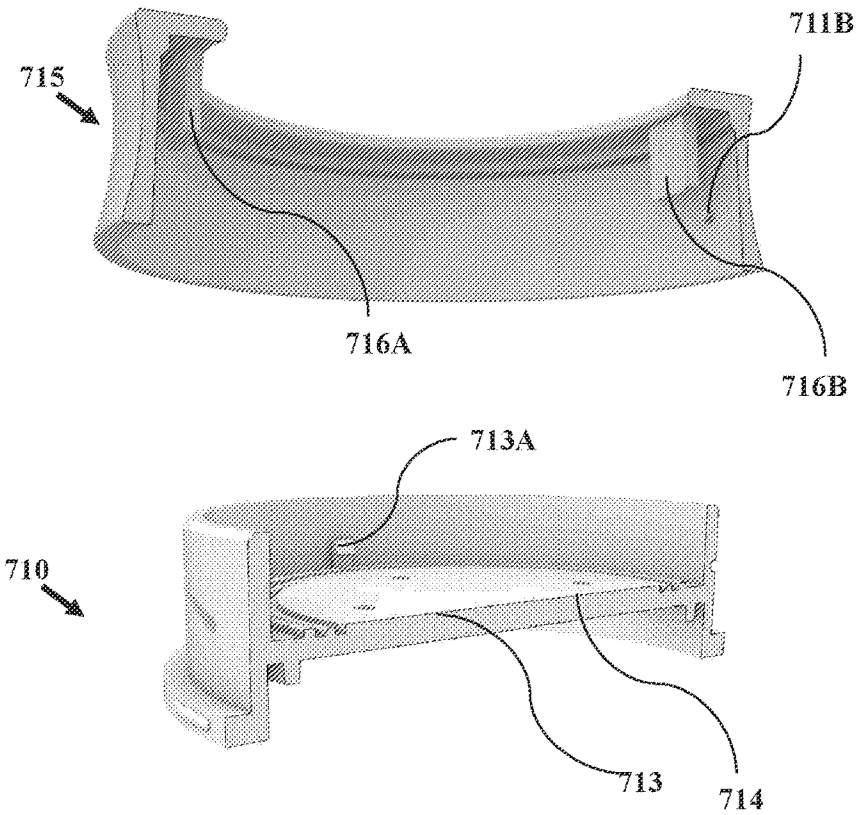
Figure 7E:
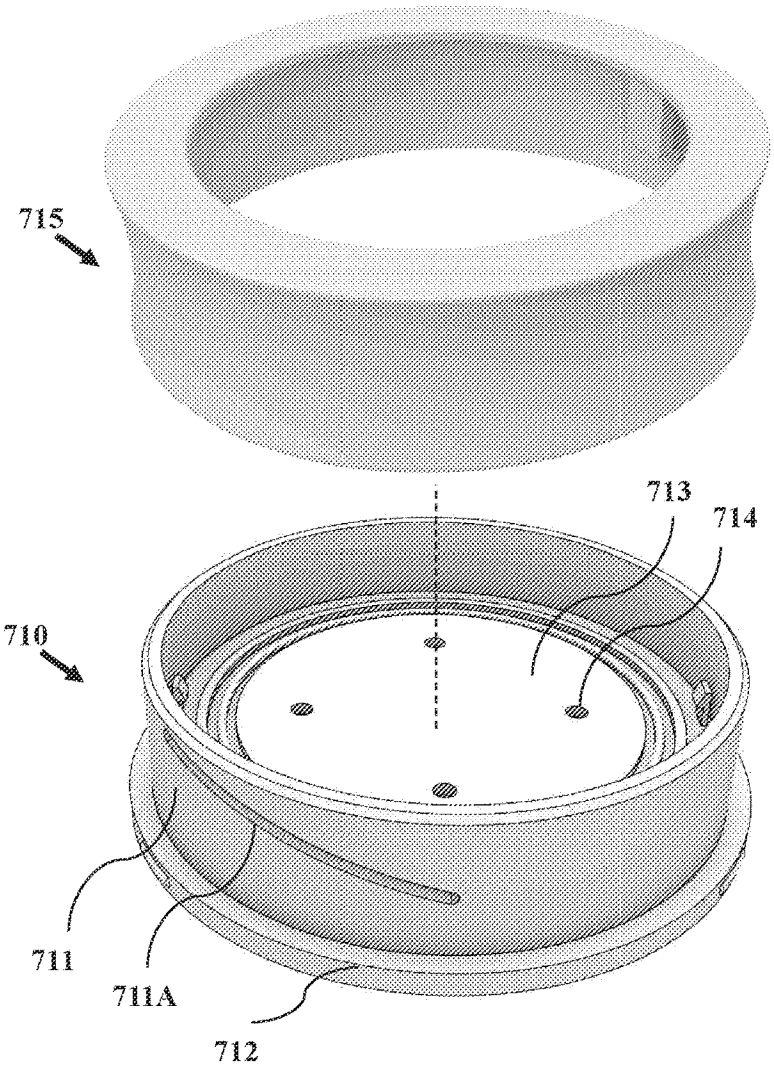

FIG. 7E illustrates portions of body 710 and sleeve 715 according to one or more embodiments. As shown in FIG. 7E, sleeve 715 may have a ring-like configuration including a flat upper surface, sleeve may engage with body 710 and retain a bristle assembly 720 (not shown in FIG. 7E). According to one embodiment, sleeve 715 may be retained body 710 and configured to rotate relative to body 710. Rotation of sleeve 715 may raise and lower sleeve 715. According to one embodiment, sleeve 715 rotates relative to sidewall 711 and along track 711-A which allows sleeve to be raised and lowered. Track 711A may be a curved channel within side wall 711 that can guide and adjust the position of sleeve 715. Sleeve 715 may include a protrusion 711B to engage with track 711A.

According to one embodiment, body 710 has a cylindrical structure have base rim 712 which may be configured to engage with base 705. Base rim 712 may also act as a stop for sleeve 715 in a lower position. According to one embodiment, body 710 includes a base plate 713 configured to receive bristle assembly base 724 of bristle assembly 720. Base plate 713 includes a plurality of openings, such as opening 714, which may allow material from body 710 to be released to bristle assembly 720. According to one embodiment, openings in base plate 713 are aligned with openings in bristle assembly base 724. According to another embodiment, openings in bristle assembly base 724 may be rotatably aligned with openings 714 to allow for dispensing and retaining material in body 710.

FIG. 7F illustrates sectional views of body 710 and sleeve 715 according to one or more embodiments. As shown in FIG. 7E, sleeve 715 may include one or more tabs, such as tabs 716AB. Tabs 716AB project down from the rim surface and into the interior region of sleeve 715 and may be used engage with side wall 711. In FIG. 7F a sectional view is shown of body 710 having base plate 713 and openings 714. Base plate 713 may also include a plurality of tabs, such as tab 713A configured to retain a base plate of a bristle assembly.

Figure 7G:
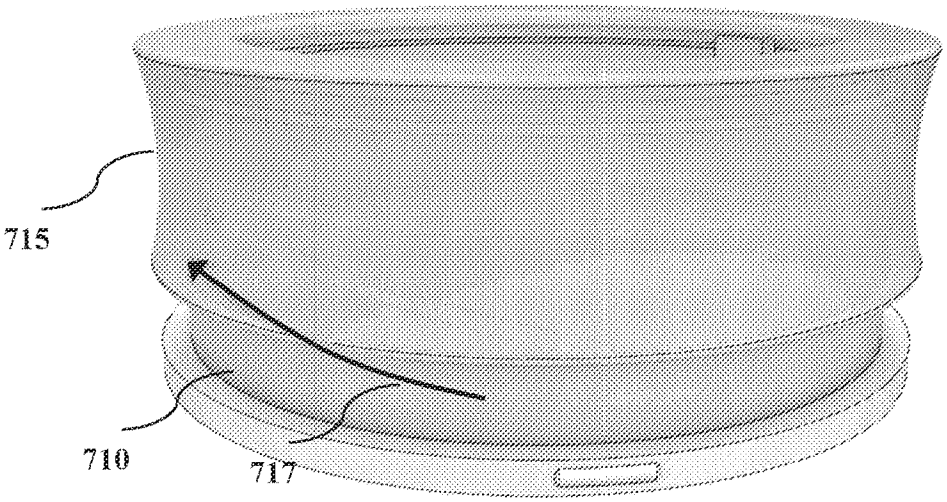

FIG. 7G, illustrates body 710 and sleeve 715 according to one or more embodiments. As shown in FIG. 7G, rotation of sleeve 715 in direction 717 (i.e., a first direction) may raise sleeve 715 relative to body 710. Rotation of sleeve in the opposite direction of direction 717 (i.e., a second direction) may lower sleeve 715.

Figure 7H:
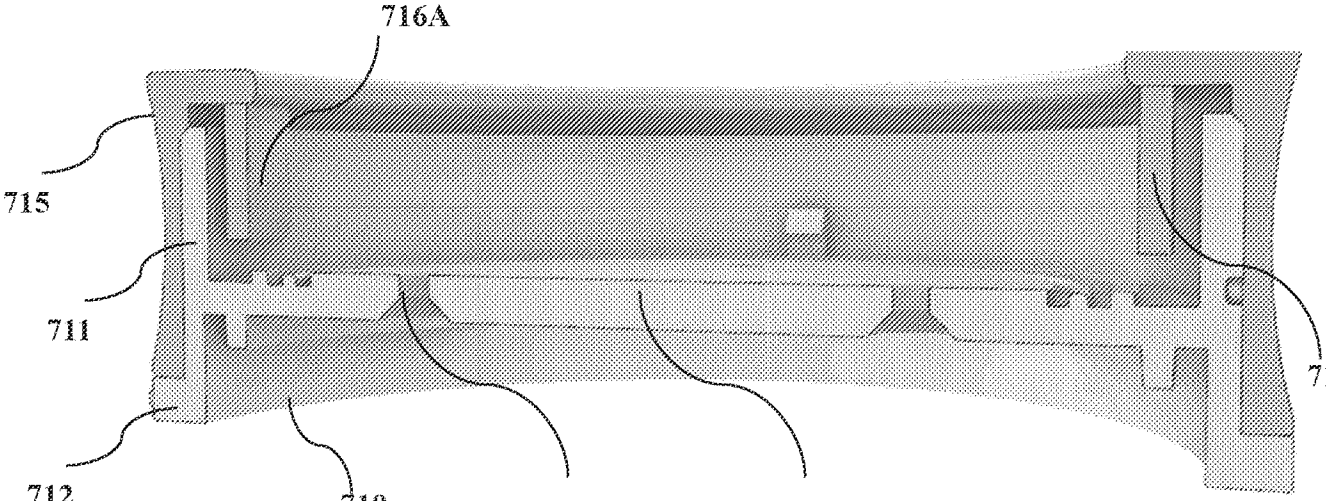

FIG. 7H illustrates a sectional view of body 710 coupled to sleeve 715 according to one or more embodiments. As shown in FIG. 7H, base rim 712 is configured to act as a stop for sleeve 715 in a lower position. Tabs 716A-716B of sleeve 715 project over side wall 711 of body 710. According to one embodiment, openings in base plate 713, such as opening 714 may have a conical lower opening and a cylindrical top configuration for allowing material from B below base plate 713 in body 710 to be provided to bristle assembly 720. As such, opening 714 may provide a flow tube configuration having a large inlet portion with tapered exit.

Figure 7J:
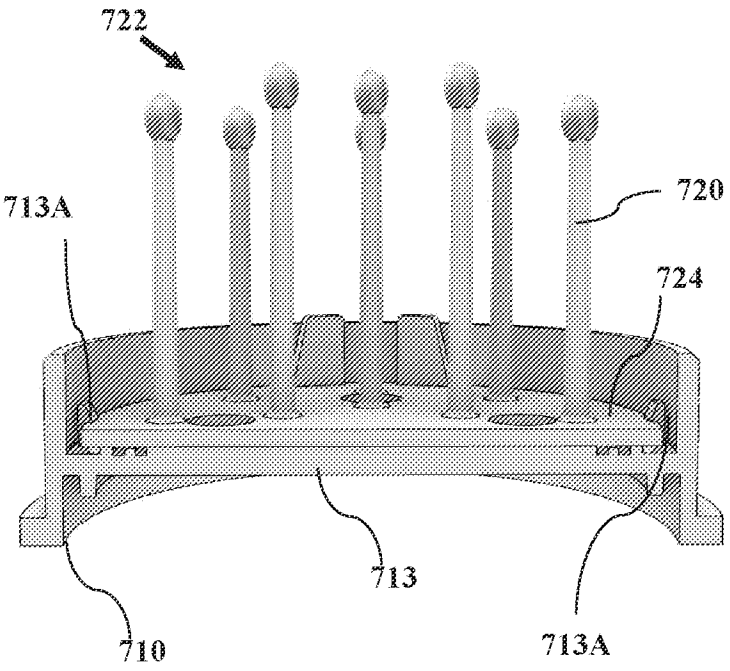
Figure 7I:
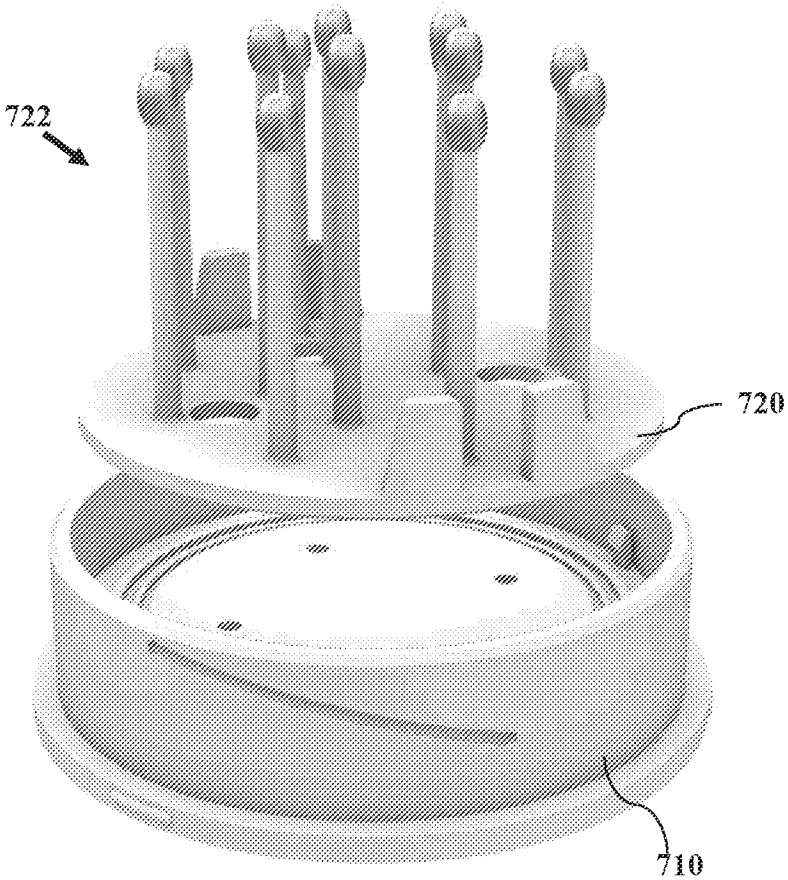

FIG. 7I illustrates of body 710 and bristle assembly 720 according to one or more embodiments. Body 710 may be configured to receive and retain bristle assembly 720 as shown in FIG. 7J. FIG. 7J illustrates a sectional view of body 710 and bristle assembly 720 according to one or more embodiments. As shown in FIG. 7J, base rim 713 is configured to retain base bristle assembly base 724 by a plurality of tabs 713A.

Figure 7K:
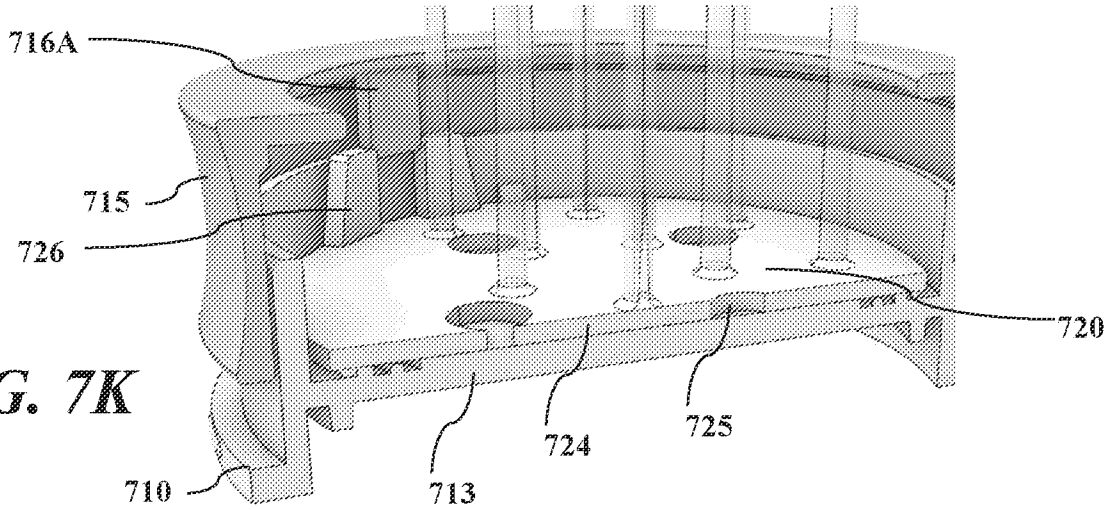
Figure 7L:
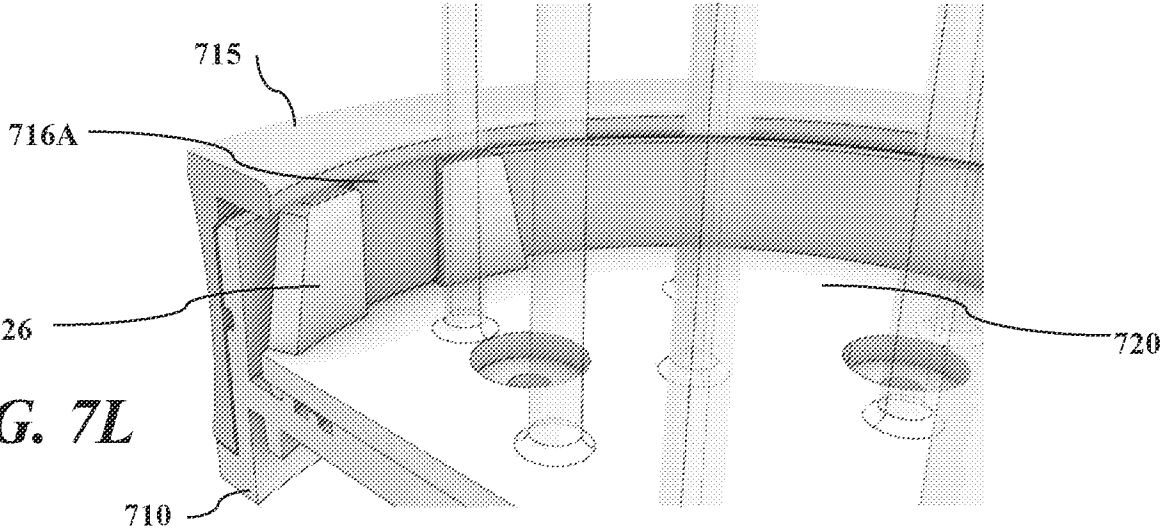

FIGS. 7K-7L illustrates a sectional view of body 710, bristle assembly 720 and sleeve 715 according to one or more embodiments. As shown in FIG. 7K, bristle assembly base 724 includes at least two raised tabs, such as tab 726, which is configured to engage with tabs 716A of sleeve 715. FIG. 7L illustrates body 710, bristle assembly 720 and sleeve 715, with sleeve 715 fully engaged to retain bristle assembly 720. FIGS. 7I-7L depict bristle assembly 720 without bristle elements 721 for the purpose of illustration.

Figure 8:
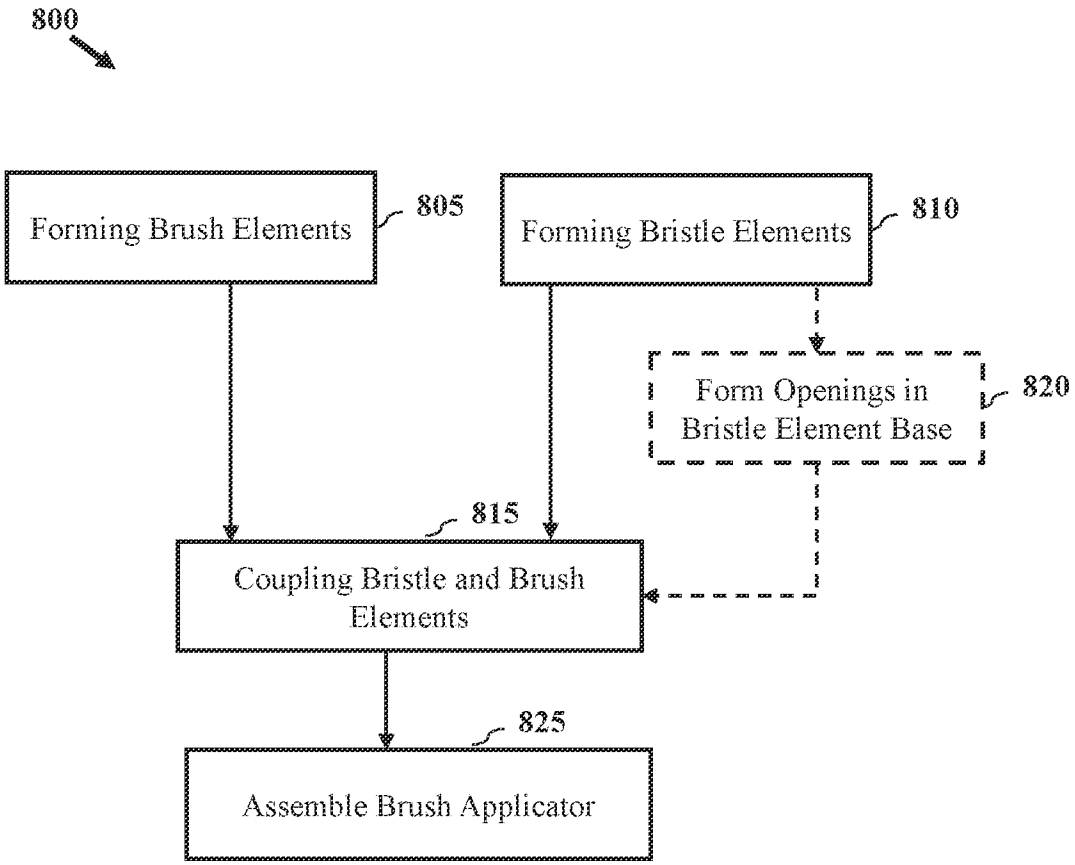
FIG. 8 depicts a manufacturing process according to one or more other embodiments.

FIG. 8 depicts a manufacturing process according to one or more embodiments. Process 800 may be employed to manufacture one or more components discussed herein. In one particular embodiment, process 800 may be employed to form a bristle assembly (e.g., bristle assembly 720), bristle configuration (e.g., bristle configuration 400), brush elements (e.g., brush elements 110, 310, 410) and bristle elements (e.g., bristle elements 105, 305, 405).

At block 805, process 800 may include forming brush elements (e.g., brush elements 110, 310, 410). According to one embodiment, brush elements may be formed having a shaft portion and spheroid end, wherein the brush elements are interspersed and formed relative to a base (e.g., base 115, bristle assembly base 724, etc.). According to another embodiment, the brush elements, may be formed with an injection molding process to form the brush elements, rounded tips and formation of a base. Forming brush elements at block 805 can eliminate additional manufacturing processing steps such as epoxy dipping hard bristles.

At block 810, bristle elements may be formed into a brush for use in a brush applicator as described herein. By way of example, in one embodiment, a plurality of fibers or bristles are collected and arranged for coupling with a base, such as a base of the brush element formed at block 805. By way of example, one end of the combined bristle tips may be formed by heating or melting the tips using a flat heated surface to form a durable bristle region such that openings can made (e.g., machined, drilled, etc.) while still maintaining a brush shape. Process 800 may optionally include forming holes in bristle elements at block 820. Holes in the bristle elements base may be formed to allow for pass through holes of the brush element base and for brush elements. In another embodiment, forming bristle elements at block 810 includes forming a plurality of bristles to a base by injection molding tufted soft bristles onto a base (e.g., base 115, bristle assembly base 724, etc.).

At block 815, brush elements formed in block 805 and bristle elements formed in block 810 are coupled together. Coupling in one embodiment, may include attaching the base of the bristle elements to the base of the brush elements to form a brush assembly with two types of bristles. In certain embodiments, bristle elements formed at block 810 may be formed after formation of the brush elements and by way of injection molding to a base of the brush elements. In certain embodiments, coupling at block 815 may include preserving one or more pathways and hole openings in the base of the brush elements and bristle elements. At block 825, one or more components of a brush application may be assembled. By way of example, a bristle assembly (e.g., bristle assembly 720) may be coupled to an inserted into a brush body (e.g., brush body 710). A sleeve (e.g., sleeve 715) may then be engaged with the brush body and around the bristle assembly. The body may then be coupled to a base (e.g., base 705).

Figure 9B:
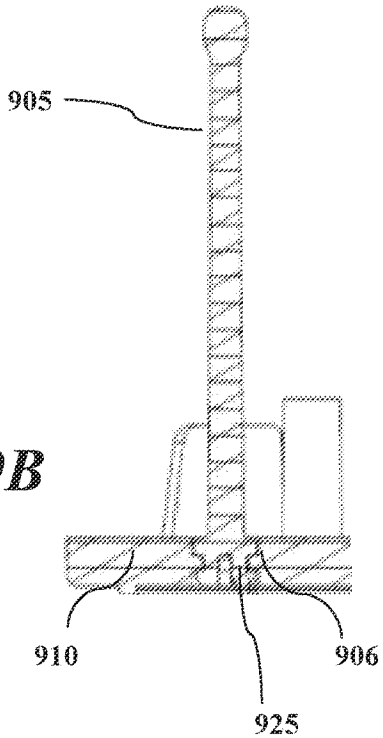
FIGS. 9A-9C depict components of a bristle assembly according to one or more embodiments.
Figure 9C:
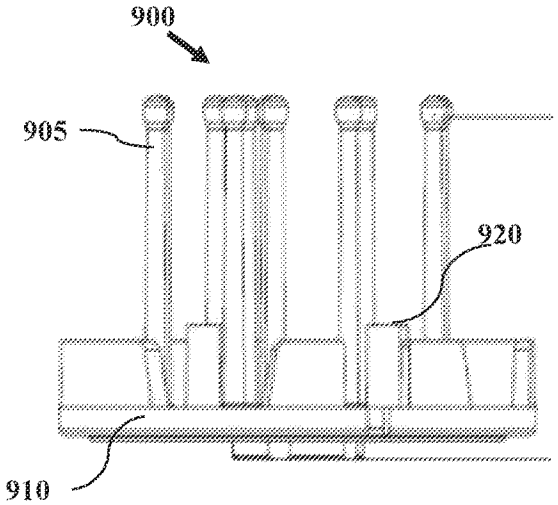
Figure 9A:
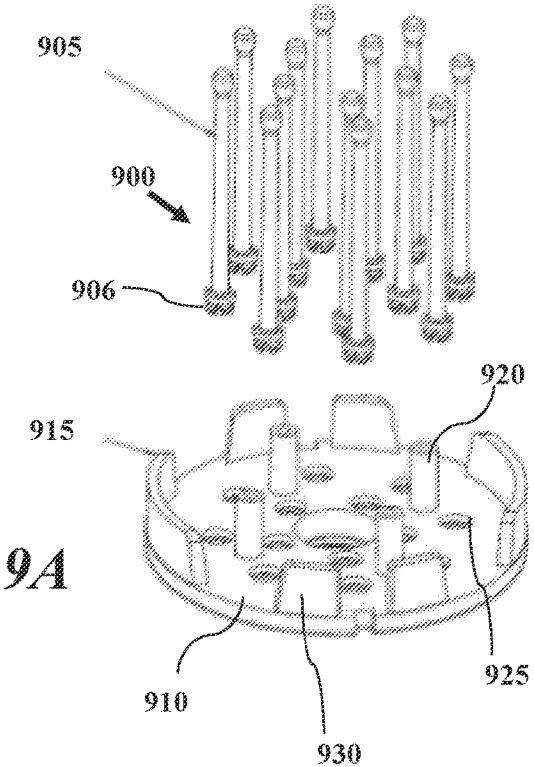

FIGS. 9A-9C depict components of a bristle assembly according to one or more embodiments. According to one embodiment, brush elements (e.g., brush elements 110, brush elements 722, etc.) and a base (e.g., bristle assembly base 724) of a bristle assembly (e.g., bristle assembly 720) may be formed separately. According to another embodiment, the brush elements may include one or more connection elements for coupling to a base.

FIG. 9A shows a plurality of brush elements 900, including brush element 905, and base 910 as components of a bristle assembly. According to one embodiment brush elements 900 and base 910 may be formed separately. Once formed, a base of a brush element, which may include one or more connection tabs/ridges shown as 906, may be configured to be coupled to openings of base 910. Base 910 may include a plurality of openings, such as opening 925, for brush elements 900. FIG. 9B illustrates a cross-sectional view of brush element 905 relative to base 910. Connection features 906 of brush element 905 may be coupled to opening 925. FIG. 9C illustrates brush elements 900 coupled to base 910.

According to another embodiment, base 910 may be configured to include one or more flow tubes, such as flow tube 920. Flow tubes of base 910 may include cylindrical/tube features that extend up from base 910. Each flow tube 910 may be associated with an opening on the bottom of base 910 and act as a channel for material stored in a container to be applied to bristle and brush elements. In certain embodiments, flow tubes, such as flow tube 920, are formed with base 910 jointly. In certain embodiments, flow tubes may be separately formed and coupled to base 910. According to one embodiment, base 910 can include a plurality of flow tubes. As shown in FIG. 9A, base 910 include four flow tubes, where each flow tube is positioned between at least two openings, such as opening 925, configured to receive brush elements. Each flow tube may be configured to provide an exit point for dry shampoo to be distributed to bristles of a brush assembly. In addition, by providing flow tubes, a bristle assembly can form or add bristles on top of base and such that the flow tubes provide a discharge location displaced from base 910. By locating flow tubes near brush elements, dry shampoo may be dispensed to brush elements.

According to one embodiment, base 910 may be formed with one or more tabs 915 and 930 (e.g., tabs 726) to interface with out or more components of a dry shampoo brush, such as a sleeve (e.g., sleeve 715). Once brush elements are combined with the base having flow tubes, soft bristles, such as plurality of brush elements (e.g., brush elements 110, brush elements 722) can be combined with base 910.

Figure 10B:
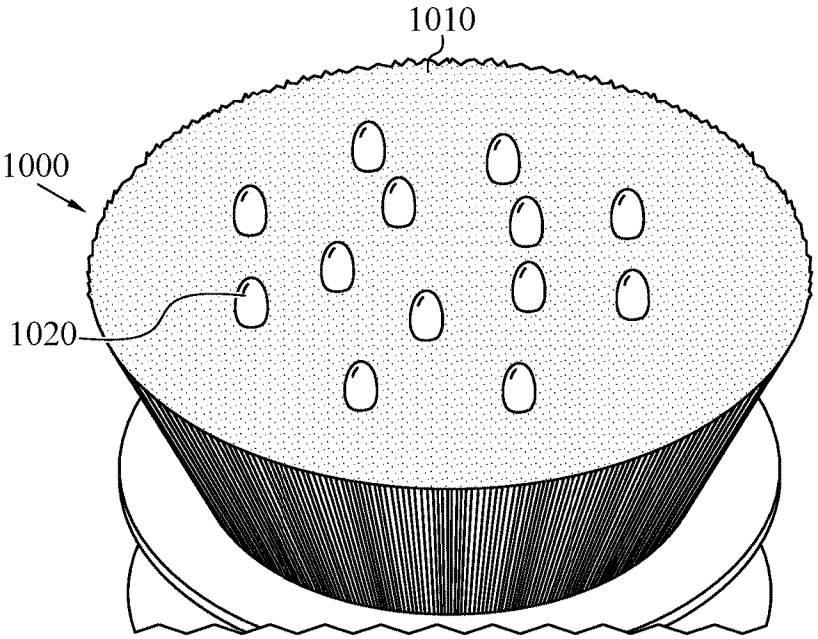
FIGS. 10A-10B depict illustrations of a bristle assembly according to one or more embodiment.
Figure 10A:
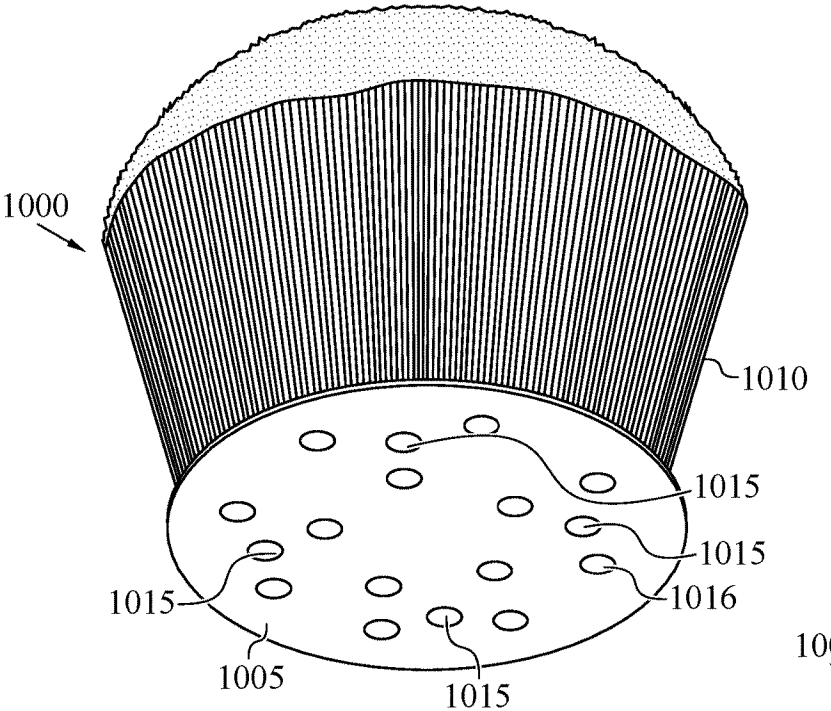

FIGS. 10A-10B depict illustrations of a bristle assembly according to one or more embodiment. FIG. 10A shows a bottom perspective view of bristle assembly 1000 (e.g., bristle assembly 720) includes a plurality of bristle elements 1010 (e.g., bristle elements 105, bristle elements 721) fixed to base 1005 (e.g., bristle assembly base 724, base 910). According to one embodiment, base 1005 includes a plurality of holes 1015 associated with flow tubes (e.g., flow tube 920) to allow for dry shampoo to be dispensed from a container of a brush to brush and bristle elements of bristle assembly 1000. The other openings in base 1005, such as opening 1016, may relate to openings for brush elements. According to one embodiment, base 1005 may be twisted when inserted into a body (e.g., body 710) to allow for holes of base 1005 and the body to be aligned for dry shampoo to be dispensed. In certain embodiments, brush assembly is configured to be twisted or rotated. As such, holes 1015 may be mis-aligned and therefore not allow dry shampoo to be dispensed, or aligned and allow for the shampoo to be dispensed. The bottom of base 1005 includes a plurality of other holes that are configured to receive brush elements. In certain embodiments, base 1005 may be a base plate for a brush applicator.

According to one embodiment, the plurality of bristle elements 1010 includes a mixed ratio of short and long soft bristles. In an exemplary embodiment, bristle elements 1010 include a 50/50 ratio of short bristles (e.g., 23 mm bristles) and longer bristles (e.g., 19 mm bristles).

According to one embodiment, FIG. 10A illustrates bristle assembly 1000 having plurality of brush elements 1010 fixed to base 1005. In one embodiment, brush elements are combined using die-cut doubled sided adhesive (tape) to base 1005. FIG. 10B illustrates a top perspective view of bristle assembly 1000 having a plurality of brush elements 1010 and plurality of bristle elements 1020. Brush elements 1010 are interspersed with the plurality of bristle elements 1020. The location of brush elements 1010 may be based on a pattern of openings, such as opening 1016 in base 1005. Once hard and soft bristles are combined, a sleeve (e.g., sleeve 715) can secure the bristle assembly 1010 and allow for the bristle assembly 1010 to twist to open and close.

While this disclosure has been particularly shown and described with references to exemplary embodiments thereof, it will be understood by those skilled in the art that various changes in form and details may be made therein without departing from the scope of the claimed embodiments.

What is claimed is:

1. A brush applicator comprising:

a bristle assembly base including at least one channel;

a plurality of bristle elements extending from the bristle assembly base, wherein the bristle elements extend out from the bristle assembly base;

a plurality of brush elements extending from the bristle assembly base, wherein the brush elements extend out from the bristle assembly base and are interspersed with the bristle elements, the brush elements each include a shaft and tip, and wherein the at least one channel of the bristle assembly base is configured to distribute material to the plurality of bristle elements and the plurality of brush elements;

a body including at least one channel and a sidewall; and a sleeve configured to retain the bristle assembly to the body, wherein the sleeve is configured to rotate relative to the sidewall and along a track, the sleeve configured to raise and lower relative to the body.

2. The brush applicator of claim 1, wherein the bristle assembly base is a portion of a bristle assembly configured to removably mount to the body and base including the at least one material.

3. The brush applicator of claim 1, wherein the plurality of bristle elements include bristles having a width smaller than each shaft of the brush elements.

4. The brush applicator of claim 1, wherein the plurality of brush elements include an inner configuration and an outer configuration of brush elements, wherein the inner configuration includes a first layout formation and the outer configuration is associated with a second layout formation.

5. The brush applicator of claim 1, wherein the bristle assembly base is configured to engage with a body to be attached, the body configured to be removably attached to at least one container by at least one of a threaded connection and a tab ring.

6. The brush applicator of claim 1, wherein the brush applicator is configured for application of dry shampoo to hair.

7. The brush applicator of claim 1, wherein the brush applicator is configured to dispense at least one of a powder, liquid and solution.

8. The brush applicator of claim 1, wherein the bristle assembly base includes at least one flow tube to dispense material to the plurality of bristle elements and the plurality of brush elements.

9. The brush applicator of claim 1, wherein the track is a curved channel within the sidewall.

10. The brush applicator of claim 1, wherein bristle assembly base includes four openings to release material and wherein the sleeve is configured to adjust the configuration of bristle elements.

11. A brush applicator comprising:

a body having a base plate, the base plate including at least one channel and a sidewall;

a base configured to be coupled to the body, the base configured to retain at least one material;

a bristle assembly including plurality of bristle elements and plurality of brush elements extending from a bristle assembly base, wherein the brush elements and are interspersed with the bristle elements, the brush elements each include a shaft and end, and wherein the at least one channel of the body is configured to distribute the at least one material to the plurality of bristle elements and the plurality of brush elements; and a sleeve configured to retain the bristle assembly to the body, wherein the sleeve is configured to rotate relative to the sidewall and along a track, the sleeve configured to raise and lower relative to the body.

12. The brush applicator of claim 11, wherein the base is configured to receive and removably mount to the body.

13. The brush applicator of claim 11, wherein the plurality of bristle elements include bristles having a width smaller than each shaft of the brush elements.

14. The brush applicator of claim 11, wherein plurality of brush elements include an inner configuration and an outer configuration of brush elements, wherein the inner configuration includes a first layout formation and the outer configuration is associated with a second layout formation.

15. The brush applicator of claim 11, wherein the bristle assembly is configured to be coupled to and retained between and the body and the sleeve, the sleeve configured to rotate to rise and lower with respect to the body.

16. The brush applicator of claim 11, wherein the brush applicator is configured for application of dry shampoo to hair, and to dispense at least one of a powder, liquid and solution.

17. The brush applicator of claim 11, wherein the bristle assembly base includes at least one flow tube to dispense material to the plurality of bristle elements and the plurality of brush elements.

18. The brush applicator of claim 11, wherein the body includes at least one tab to retain the bristle assembly to the base plate of the body.

19. The brush applicator of claim 11, wherein track is a curved channel within the sidewall.

20. The brush applicator of claim 11, wherein the body and a bristle assembly base includes four openings to release material from the base to the bristle assembly and wherein the sleeve is configured to adjust the configuration of bristle elements.

* * * * *